US006844890B1

(12) United States Patent
Morgan

(10) Patent No.: US 6,844,890 B1
(45) Date of Patent: Jan. 18, 2005

(54) TONER CARTRIDGE ADAPTOR

(75) Inventor: John Morgan, Newbury Park, CA (US)

(73) Assignee: Hitachi Printing Solutions America, Inc., Simi Valley, CA (US)

( * ) Notice: Subject to any disclaimer, the term of this patent is extended or adjusted under 35 U.S.C. 154(b) by 0 days.

(21) Appl. No.: 10/683,714

(22) Filed: Oct. 10, 2003

(51) Int. Cl.[7] ..... G03G 21/18; G03G 15/08

(52) U.S. Cl. ..... 347/228; 399/111

(58) Field of Search ..... 347/228; 399/111, 399/106, 120, 119, 110, 126, 258

(56) References Cited

U.S. PATENT DOCUMENTS 5,155,663 A * 10/1992 Harase ..... 361/684
5,278,410 A * 1/1994 Boutet et al. ..... 250/589

FOREIGN PATENT DOCUMENTS

JP 2-301773 * 12/1990 ..... 399/111

* cited by examiner

*Primary Examiner*—Huan Tran
(74) *Attorney, Agent, or Firm*—Kaplan & Gilman, LLP

(57) ABSTRACT

An apparatus for adapting a smaller toner cartridge for use in laser printers or copiers which otherwise accept and use only larger toner cartridges. The apparatus expands the width of the cartridge.

13 Claims, 2 Drawing Sheets

TONER CARTRIDGE ADAPTOR

BACKGROUND OF THE INVENTION

Modern laser printers operate in essentially the following manner: An electrostatically charged drum is exposed to light on portions which correspond to the light and dark portions of a digital image to be printed on a page. The exposed portions of the drum are discharged, while the remaining drum portions remain charged. The charged portions of the drum attract particles of dry powdered ink called toner. Paper is then pressed about the drum such that the toner leaves an image imprint on the paper. The paper is then run through a heated roller which, through heat and pressure, fuses and bonds the toner to the paper, resulting in a piece of paper imprinted with the image desired to be printed. Modern copiers operate in a similar manner, wherein the electrostatically charged drum is exposed to light on portions that correspond to the light and dark portions of an image to be copied. These portions of the image are determined by exposing the image itself to a light source and determining which portions reflect the light and which absorb it.

The toner used by the printer or copier is typically stored in replaceable cartridges. When toner in the cartridge is used up, the empty cartridge is removed from the printer and replaced with a full cartridge.

Toner cartridges are manufactured in many different configurations and sizes. In many cases, a manufacturer will produce cartridges that are substantially similar in overall configuration to each other, but differ in size. This size difference may exist for a variety of reasons, 1) to contain varying amounts of toner to accommodate varying amounts of toner use (light duty vs. heavy duty usage), 2) to conform to various printer/copier configurations (smaller or light duty machines vs. larger or heavy duty machines), or to conform to differences in how individual printer/copier models are designed and manufactured.

SUMMARY OF THE INVENTION

The present invention provides an apparatus for adapting smaller toner cartridges for use in laser printers/copiers which otherwise accept only larger toner cartridges.

Toner cartridges often include various mechanisms for engaging the cartridge within a printer or copier, opening and closing a cartridge door to release toner, and transferring the toner from the cartridge to the paper within the printer or copier. It provides the versatility of using smaller toner cartridges in machines designed to accept larger cartridges when it is economically or logistically desirable to do so. A printer/copier user may find that his use of the printer or copier is such that more expensive, larger toner cartridges are not necessary. Instead, a user can quickly attach the present invention to a smaller toner cartridge making it suitable for use with printers or other equipment designed to accept only larger cartridges.

It is therefore an object of the present invention to adapt smaller toner cartridges for use in laser printers/copiers which otherwise accept only larger toner cartridges.

DETAILED DESCRIPTION OF THE PREFERRED EMBODIMENT

Figure 1:
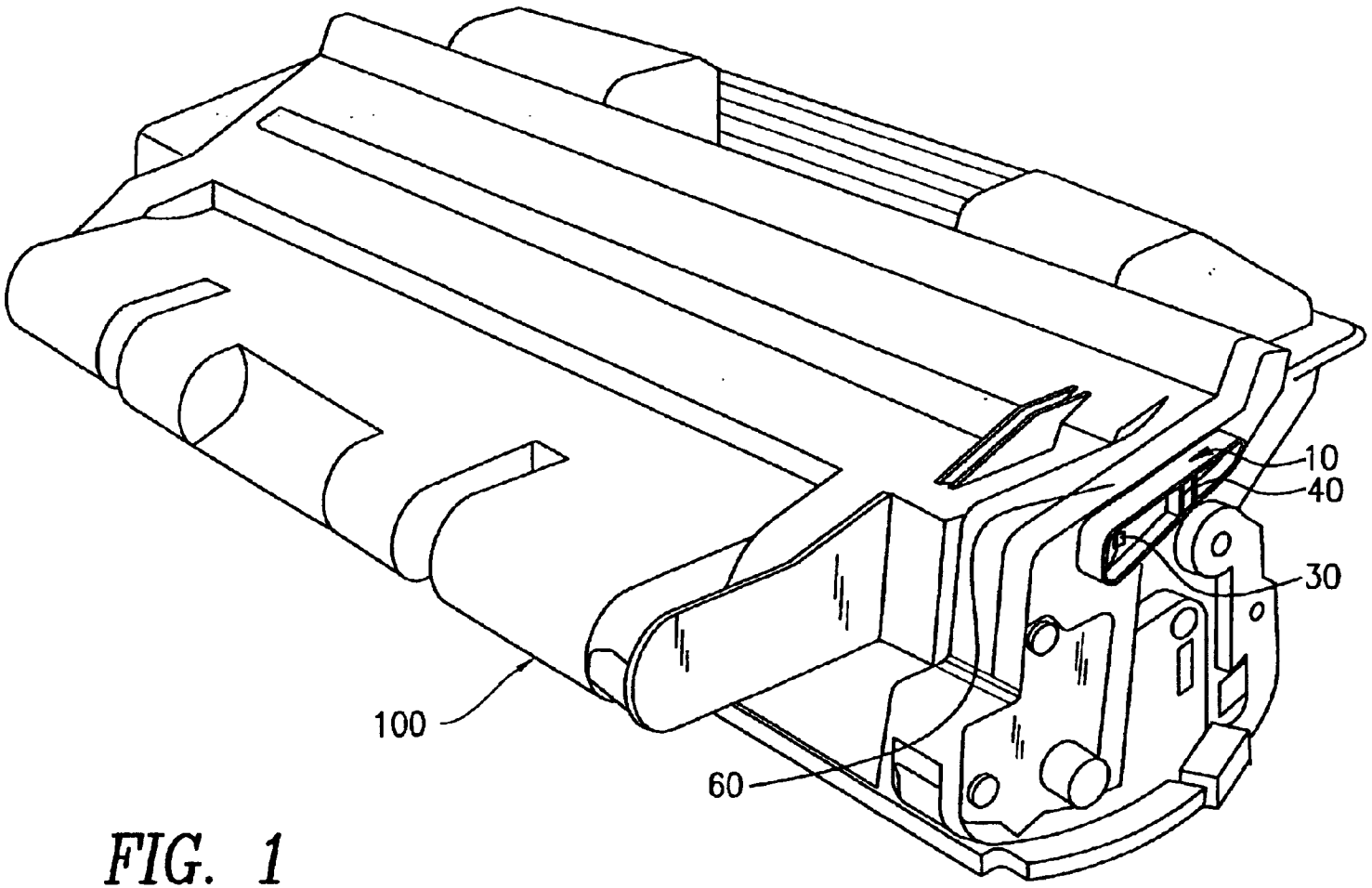
FIG. 1 is a front perspective view of a preferred embodiment of the invention attached to a toner cartridge.
Figure 2:
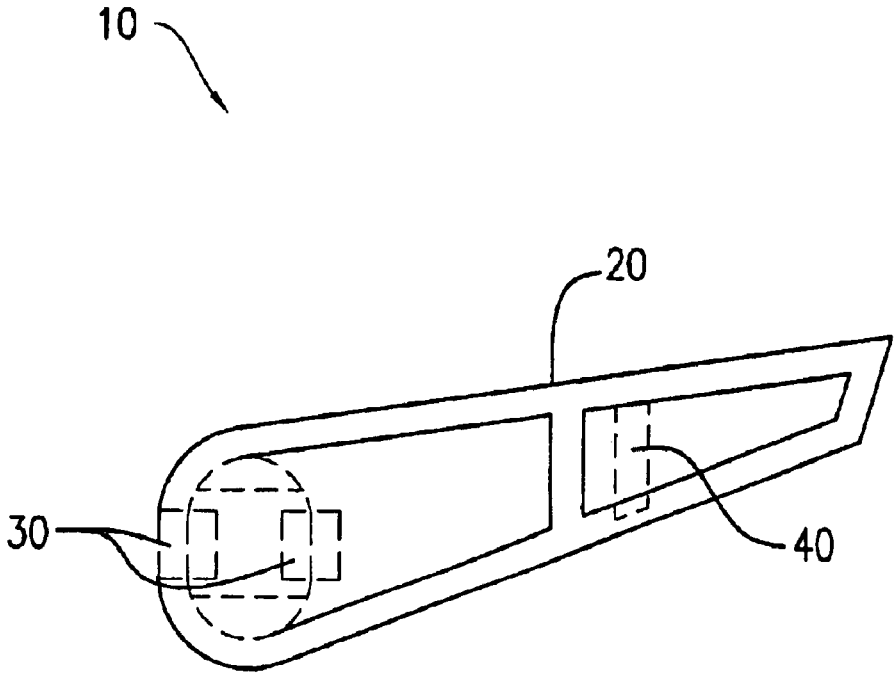
FIG. 2 is a rear perspective view of a preferred embodiment of the invention.

FIG. 1 is an illustration of a small toner cartridge 100 with an attached adapter 10 of a preferred embodiment of the present invention. Adapter 10 is preferably constructed of plastic. Now, referring to FIG. 2, a preferred embodiment of adapter 10 is disclosed. Base 20 is configured to act as a rail or similar lateral portion of the housing of a larger toner cartridge. The configuration of base 20 is such that a smaller toner cartridge 100, as shown in FIG. 1, can be properly engaged within a printer or copier designed to accommodate only a larger toner cartridge. Brackets 30 and 40 facilitate the attachment of lengthening adapter 10 to a smaller toner cartridge 100. Brackets 30 are notched such that adapter 10 remains attached to smaller toner cartridge 100. Bracket 40 provides a second degree of support to adapter 10, insuring it stays in proper alignment so that it may engage smaller toner cartridge 100. Brackets 30 and 40 are snapped within corresponding openings in wall portion 60 of cartridge 100. With adapter 10 installed, smaller toner cartridge 100 can be engaged within a printer or copier, as if it were a larger toner cartridge.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be apparent to those skilled in the art, and are contemplated to be within the scope of the appended claims.

What is claimed is:

1. An apparatus for adapting a toner cartridge comprising:

a base; and an attachment mechanism for removably attaching said base to a lateral side of said toner cartridge so as to form a larger toner cartridge suitable to be mounted in a printing device.

2. An apparatus of claim 1, wherein said base has a configuration similar to a lateral portion of a housing of said larger toner cartridge.

3. An apparatus of claim 2, wherein said printing device is a printer.

4. An apparatus of claim 2, wherein said printing device is a copier.

5. An apparatus of claim 1, wherein said attachment mechanism comprises at least one bracket adapted to be snapped in an opening formed on said lateral side of said toner cartridge.

6. An apparatus of claim 5, wherein said bracket is a notched bracket.

7. A method for adapting a toner cartridge for use in a printing device comprising the steps of:

connecting an apparatus for adapting said toner cartridge, comprising a base and an attachment mechanism, to a lateral side of said toner cartridge to form a larger toner cartridge suitable to be mounted in said printing device; and engaging said toner cartridge within said printing device.

8. The method of claim 7, wherein said step of connecting includes a step of engaging at least two brackets of said attachment mechanism with corresponding openings provided on said lateral side of said toner cartridge.

9. An apparatus of claim 2, wherein said base is generally a flat plate in shape.

10. A toner cartridge kit comprising:

a toner cartridge of a length having a lateral side; and an adaptor having a base and an attachment mechanism for removably attaching said base to said lateral side of said toner cartridge so as to form a larger toner cartridge suitable to be mounted in a printing device.

11. A toner cartridge kit of claim 10, wherein said attachment mechanism comprises at least one bracket provided on said base and at least one opening formed on said lateral side of said toner cartridge for engaging with said bracket of said base.

12. A toner cartridge kit of claim 10, wherein said base of said adaptor has a configuration similar to a lateral portion of a housing of said larger toner cartridge.

13. A toner cartridge kit of claim 12, wherein said base of said adaptor is generally a flat plate in shape.

* * * * *